US009001023B2

(12) United States Patent
Mashiba et al.

(10) Patent No.: US 9,001,023 B2
(45) Date of Patent: Apr. 7, 2015

(54) LIQUID CRYSTAL DISPLAY APPARATUS

(71) Applicant: Sharp Kabushiki Kaisha, Osaka-shi, Osaka (JP)

(72) Inventors: Tamaki Mashiba, Osaka (JP); Junko Yabuta, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 119 days.

(21) Appl. No.: 13/658,770

(22) Filed: Oct. 23, 2012

(65) Prior Publication Data

US 2013/0106680 A1 May 2, 2013

(30) Foreign Application Priority Data

Oct. 26, 2011 (JP) ..... 2011-234543

(51) Int. Cl.
*G09G 3/36* (2006.01)
*G09G 3/34* (2006.01)

(52) U.S. Cl.
CPC ..... *G09G 3/3413* (2013.01); *G09G 3/36* (2013.01); *G09G 2320/0666* (2013.01); *G09G 2360/14* (2013.01); *G09G 2360/144* (2013.01)

(58) Field of Classification Search
USPC ..... 345/102, 204; 349/61–71; 362/97.1–97.3
See application file for complete search history.

(56) References Cited

U.S. PATENT DOCUMENTS 5,818,553 A * 10/1998 Koenck et al. ..... 349/61
6,822,683 B1 * 11/2004 Torikai ..... 348/333.13
7,002,546 B1 * 2/2006 Stuppi et al. ..... 345/102
7,710,387 B2 * 5/2010 Yamaguchi ..... 345/102
8,310,435 B2 * 11/2012 Kang et al. ..... 345/102
8,487,850 B1 * 7/2013 Cole et al. ..... 345/88
8,552,969 B2 * 10/2013 Huang ..... 345/102
8,850,714 B2 * 10/2014 Matsui ..... 34/179
2001/0013854 A1 * 8/2001 Ogoro ..... 345/102
2002/0030660 A1 * 3/2002 Arakawa ..... 345/102
2003/0222840 A1 * 12/2003 Yamaguchi ..... 345/102
2003/0231161 A1 * 12/2003 Yamaguchi ..... 345/102

(Continued)

FOREIGN PATENT DOCUMENTS

JP 2004-170721 A 6/2004
JP 2007-279543 A 10/2007
JP 2008-090076 A 4/2008
JP 2009-003433 A 1/2009

(Continued)

*Primary Examiner* — Lun-Yi Lao
*Assistant Examiner* — Kelly B Hegarty
(74) *Attorney, Agent, or Firm* — Keating & Bennett, LLP

(57) ABSTRACT

Adjustment of white balance based on a measurement result of light emission luminance of a backlight is allowed to be executed accurately and effectively. A backlight luminance detection portion detects light emission luminance of an LED backlight in a state where an optical shutter of a liquid crystal display panel is closed. A main control portion adjusts light emission luminance of the LED backlight according to light emission luminance detected by the backlight luminance detection portion. Here, the main control portion compares light emission luminance of LEDs of RGB detected by the backlight luminance detection portion with light emission luminance of RGB in white balance adjustment that is stored in advance in the storage portion, and adjusts, when an error occurs between the compared light emission luminance, the light emission luminance of each of the LEDs of RGB so as to eliminate the error.

4 Claims, 5 Drawing Sheets

(56) References Cited

U.S. PATENT DOCUMENTS

| | | | | |
|---|---|---|---|---|
| 2004/0095402 | A1 | 5/2004 | Nakano | |
| 2005/0110742 | A1* | 5/2005 | Arakawa | 345/102 |
| 2006/0274027 | A1* | 12/2006 | Yamaguchi | 345/102 |
| 2006/0280360 | A1* | 12/2006 | Holub | 382/162 |
| 2007/0035706 | A1 | 2/2007 | Margulis | |
| 2008/0284720 | A1 | 11/2008 | Fukutome | |
| 2011/0007103 | A1* | 1/2011 | Han et al. | 345/690 |

FOREIGN PATENT DOCUMENTS

| | | | |
|---|---|---|---|
| JP | 2009-512896 | A | 3/2009 |
| JP | 2009-081647 | A | 4/2009 |
| JP | 2009-211938 | A | 9/2009 |
| JP | 2010-128040 | A | 6/2010 |
| JP | 2011-085693 | A | 4/2011 |

* cited by examiner

LIQUID CRYSTAL DISPLAY APPARATUS

CROSS-REFERENCE TO RELATED APPLICATION

This non-provisional application claims a priority under 35 U.S.C. §119(a) on Patent Application No. 2011-234543 filed in JAPAN on Oct. 26, 2011, the entire contents of which are hereby incorporated herein by reference.

FIELD OF THE INVENTION

The present invention relates to a liquid crystal display apparatus, and more specifically, to a display apparatus provided with means to adjust white balance of a liquid crystal display panel.

BACKGROUND OF THE INVENTION

Recently, a monitor apparatus, a television receiver and the like using a liquid crystal display panel are becoming more and more popular. Especially, in recent years, a size of a display screen of a liquid crystal display apparatus is increased and some of which are used for a purpose of advertisement display by, for example, setting a large-screen display on a street or the like. In such a liquid crystal display apparatus, since liquid crystal itself does not emit light, a backlight using, for example, an LED (Light Emitting Diode) is arranged on a back side of a liquid crystal display panel so that with irradiated light thereof, display with high luminance is performed.

In a color type display apparatus represented by a liquid crystal display apparatus using a liquid crystal display panel, adjustment of white balance is important. In adjustment of white balance, for example, input RGB signals are not directly output to a display but output after performing correction (γ correction) to each of the RGB signals so that especially white color is appropriately expressed.

However, there is a problem that light emission luminance of a backlight of a liquid crystal apparatus is changed due to switching between light modulation levels of the backlight or an elapsed time after powered on, so that white balance varies to cause reduction in video image quality.

Concerning a technology for appropriately performing white balance adjustment to display a video image with high display quality, for example, Japanese Laid-Open Patent Publication No. 2010-128040 discloses a display apparatus provided with correction means to perform γ correction to an input video image and detection means to detect luminance of a backlight, in which different γ correction is performed for each of RGB with the correction means according to a luminance level detected by the detection means.

As described above, detecting luminance of a backlight emitting light and adjusting white balance using a detected result is a useful technique. However, when light emission luminance of a backlight is detected for using in adjustment of white balance, when the backlight is turned on for adjustment of white balance, light from the backlight is transmitted through the liquid crystal display panel to be emitted to a front side depending on a state of a liquid crystal display panel. That is, on the liquid crystal display panel, in displaying an input video image signal, an oriented state of liquid crystal is changed according to gradation of the input video image signal, and gradation expression is performed by a function of an optical shutter. At this time, a transmitted light amount of the liquid crystal display panel is changed depending on a state of an optical shutter so that an amount of light incident on a detection sensor for detecting light emission luminance of the backlight does not become stable, thus resulting in reduction in detection accuracy.

SUMMARY OF THE INVENTION

The present invention aims to provide a liquid crystal display apparatus which enables to execute adjustment of white balance based on a measurement result of light emission luminance of a backlight accurately and effectively.

An object of the present invention is to provide a liquid crystal display apparatus comprising: a liquid crystal display panel; a backlight for illuminating the liquid crystal display panel from a back side thereof; a control portion for controlling the liquid crystal display panel and the backlight; and a backlight luminance detection portion for detecting light emission luminance of the backlight on the back side of the liquid crystal display panel, wherein the backlight luminance detection portion detects light emission luminance of the backlight in a state where an optical shutter of the liquid crystal display panel is closed, and the control portion adjusts light emission luminance of the backlight according to the light emission luminance detected by the backlight luminance detection portion.

Another object of the present inventions is to provide the liquid crystal display apparatus, wherein the backlight is comprised of LEDs in three colors of RGB, a storage portion is provided for storing, when light of each of the LEDs of RGB is emitted in a state where white balance is adjusted in advance, light emission luminance of each of RGB detected by the backlight luminance detection portion, the backlight luminance detection portion detects light emission luminance of each of the LEDs of RGB when adjusting light emission luminance of the backlight, and the control portion compares the light emission luminance of RGB detected by the backlight luminance detection portion with light emission luminance of RGB stored in the storage portion, and adjusts, when an error occurs between the compared light emission luminance, the light emission luminance of each of the LEDs of RGB so as to eliminate the error.

Another object of the present inventions is to provide the liquid crystal display apparatus, wherein an ambient illuminance detection portion for detecting ambient illuminance of the liquid crystal display apparatus is included, and the control portion executes processing to adjust light emission luminance of the backlight according to light emission luminance detected by the backlight luminance detection portion when ambient illuminance detected by the ambient illuminance detection portion is higher than a predetermined threshold.

Another object of the present inventions is to provide the liquid crystal display apparatus, wherein a clock for detecting a current time is included, and the control portion executes processing to adjust light emission luminance of the backlight according to light emission luminance detected by the backlight luminance detection portion when a current time detected by the clock belongs to a predetermined time slot or matches a predetermined time.

PREFERRED EMBODIMENTS OF THE INVENTION

Figure 1:
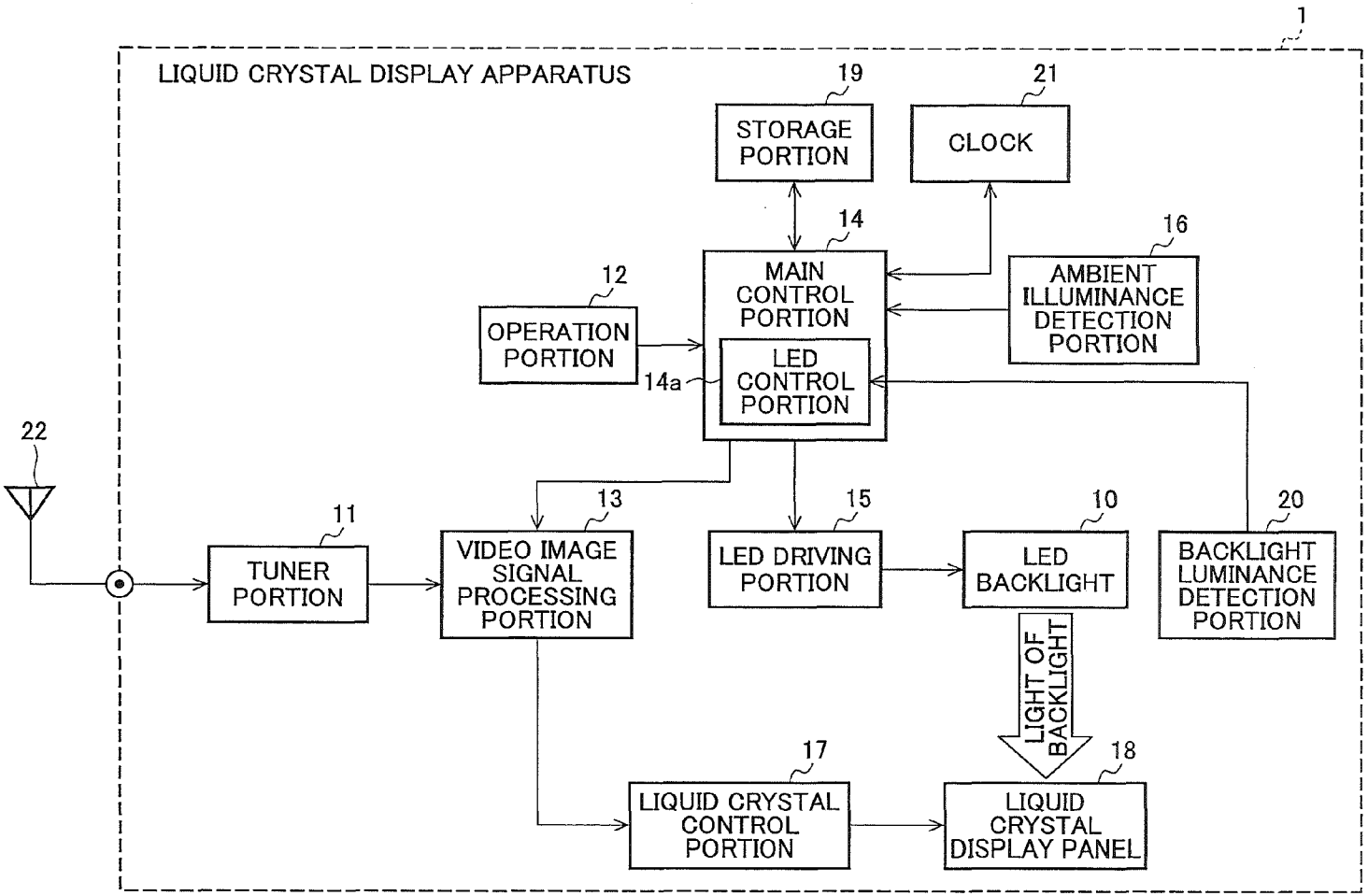
FIG. 1 is a block diagram showing a configuration example of a liquid crystal display apparatus according to the present invention.

FIG. 1 is a block diagram showing a schematic configuration example of a liquid crystal display apparatus according to the present invention. A liquid crystal display apparatus 1 is provided with an LED backlight 10, a tuner portion 11, an operation portion 12, a video image signal processing portion 13, a main control portion 14, an LED driving portion 15, an ambient illuminance detection portion 16, a liquid crystal control portion 17, a liquid crystal display panel 18, a storage portion 19, a backlight luminance detection portion 20, and a clock 21.

The liquid crystal display panel 18 is a non-self luminous type panel. The LED backlight 10 which constitutes a backlight of the present invention has an LED as a light source and illuminates the liquid crystal display panel 18 from a back side thereof with light emission of the LED. The main control portion 14 controls whole inside the liquid crystal display apparatus 1 including the video image signal processing portion 13, the LED driving portion 15 and the like directly or indirectly. The main control portion 14 includes an LED control portion 14*a* for controlling the LED driving portion 15.

The operation portion 12 is to accept user operation for transmitting a content of the operation to the main control portion 14, and includes a main body operation portion disposed in a main body of the liquid crystal display apparatus 1 and a reception portion for receiving an operation signal from an accompanying remote controller.

The tuner portion 11 demodulates a broadcast signal which is received and input by an antenna 22 for output to the video image signal processing portion 13. The video image signal processing portion 13 performs various signal conversion processing for displaying a video image signal output from the tuner portion 11 on the liquid crystal display panel 18. The liquid crystal display apparatus is configured as a liquid crystal television apparatus by including the tuner portion 11 and the like.

The liquid crystal control portion 17 performs control for writing a video image signal output from the video image signal processing portion 13 on the liquid crystal display panel 18 beginning at a topmost line sequentially. On the liquid crystal display panel 18, vertical scanning for writing to update a sequential scanning video image signal is performed. The written video image signal of one frame is held. Such writing allows a video image shown by the input video image signal to be displayed on the liquid crystal display panel 18.

The LED backlight 10 having LEDs as light sources arranged in a matrix state is to illuminate the liquid crystal display panel 18 from a back side thereof. The LEDs are configured so that a plurality of respective LEDs in three colors of RGB are arranged so that all of which altogether are able to irradiate white light.

The backlight luminance detection portion 20 is to detect light emission luminance of the LED of the LED backlight 10, in which as a detection sensor, a photo sensor is used. A detection signal output from the photo sensor is subjected to AD conversion to be output to the main control portion 14.

The main control portion 14 adjusts light emission luminance of the LED backlight 10 based on the light emission luminance of the LED detected by the backlight luminance detection portion 20 so that video image display is performed in constant white balance at all times. The light emission detection of the LED and adjustment processing of the light emission luminance of the LED are characterizing parts of the display apparatus according to the present invention.

The ambient illuminance detection portion 16 is comprised of an OPC (Optical Picture Control) sensor for detecting ambient illuminance of the liquid crystal display apparatus 1 (also referred to as brightness sensor). Light emission luminance of the LED backlight 10 is configured to be able to be controlled according to the ambient illuminance of the liquid crystal display apparatus 1 detected by the OPC sensor.

In an embodiment according to the present invention, when the ambient illuminance detected by the ambient illuminance detection portion 16 is higher than a predetermined threshold, adjustment processing of light emission luminance of an LED is performed based on light emission luminance detection of an LED.

Further, the LED control portion 14*a* of the main control portion 14 receives a light modulation control signal generated according to a light modulation value specifying light emission luminance of the LED backlight 10 and controls light emission luminance of the LED backlight 10 through the LED driving portion 15. The light modulation value is, for example, a value determined based on a setting value set by user operation with a screen brightness setting menu and a detected value of ambient illuminance by the ambient illuminance detection portion 16, which is set as a value corresponding to each stage of multiple stages into which a light emission luminance controlling range (light modulation level) of the LED backlight 10 is divided.

That is, a light modulation level is set according to the setting by user operation or a detection result by the ambient illuminance detection portion 16, and light emission luminance of the LED backlight 10 is controlled with light emission luminance according to the light modulation level. Though there is a possibility of disturbance in white balance due to change in a light modulation value, in the embodiment according to the present invention, luminance of the backlight is adjusted based on the detection result of the light emission luminance of the LED backlight, thereby making it possible to perform video image display in constant white balance.

A light emission luminance adjustment system of an LED includes a pulse width modulation (PWM) system and a current value control system. The PWM system is a system of changing duty indicating a lighting time per cycle in a pulse for turning on/off the LED. Moreover, the current value control system is a system for changing a current value (forward current value) applied to an LED.

The storage portion 19 is storage means capable of storing data such as a ROM, a RAM, an HD and the like, and holds data of light emission luminance for maintaining the white balance appropriately. The data includes data showing a light emission control amount of an LED when white balance is adjusted in a plant or the like at the time of manufacturing the liquid crystal display apparatus 1 and data showing light emission luminance of the LED by the backlight luminance detection portion 20 at the time. The data of the light emission control amount is, for example, duty at the time of turning on/off the LED by PWM control. Alternatively, a current value at the time of controlling the current value control may be applicable.

In the embodiment according to the present invention, light emission control is performed individually for each of LEDs of RGB in order to obtain appropriate white balance, data of a light emission control amount of an LED and data of light emission luminance detected by the backlight luminance detection portion 20 are stored for each of RGB.

Further, the data of a light emission control amount of an LED and the data of light emission luminance detected by the backlight luminance detection portion 20 described above may be stored according to a light modulation level. When the light modulation level changes, a light emission luminance level of an LED changes so that data of light emission control amount which is optimum at each light modulation level and detected data by the backlight luminance detection portion 20 at the time are stored in the storage portion 19.

Note that, in the liquid crystal display apparatus according to the present invention, a light modulation setting function in multiple stages based on a detected result by the ambient illuminance detection portion 16 or an user operation is not essential, and one with the LED backlight 10 emitting light at a predetermined light emission level may be applicable. In this case, data to be stored in the storage portion 19 is assumed to be light emission control amount data of each LED at the time of adjusting white balance at a predetermined light emission level and data of light emission luminance detected at the time by the backlight luminance detection portion 20.

In the case of performing adjustment processing of luminance of a backlight based on a detection result of light emission luminance of the backlight, the LED control portion 14*a* of the main control portion 14 causes the backlight luminance detection portion 20 to detect light emission luminance in a state where the LED backlight 10 is turned on. The detected data of light emission luminance is able to be stored temporarily in the storage portion 19.

At this time, the main control portion 14 controls the liquid crystal display panel 18 to fully close an optical shutter. For example, for all pixels on the liquid crystal display panel 18, a video image signal at a lowest gradation (black) is input so that display at the lowest gradation is performed with all the target pixels.

Then, the main control portion 14 compares the light emission luminance of the LED detected by the backlight luminance detection portion 20 with light emission luminance of the LED stored in the storage portion 19 in advance, and when there is an error occurred therebetween, adjustment to increase or decrease the light emission luminance of the LED is performed so as to eliminate the error. Here, LEDs of RGB are turned on sequentially so that light emission luminance for each of RGB is detected by the backlight luminance detection portion 20 to be compared with stored data in the storage portion 19 for performing light emission control.

When the light emission luminance of each of LEDs of RGB is adjusted so that actual light emission luminance detected by the backlight luminance detection portion 20 reaches a predetermined light emission luminance level stored in the storage portion 19, it is possible to perform video image display in the white balance set initially. At the time, when light emission luminance control amount data and detected data by the backlight luminance detection portion 20 is stored according to a light modulation level, light emission luminance control of an LED is performed by using stored data according to a current light modulation level.

Figure 2:
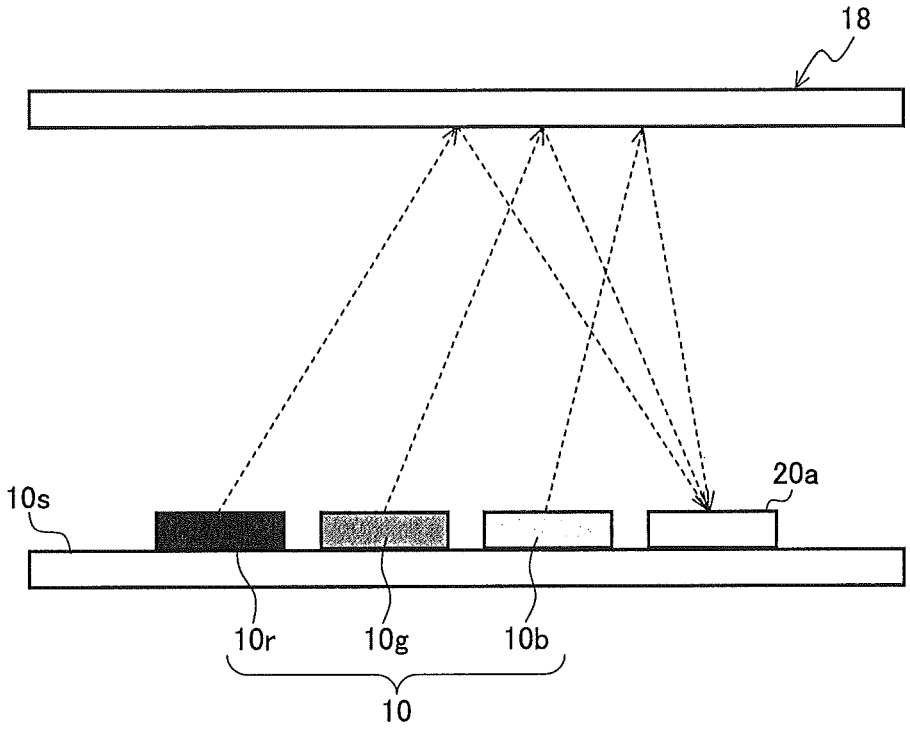
FIG. 2 is a diagram for explaining a configuration of an LED backlight and a liquid crystal panel.

FIG. 2 is a diagram for explaining a configuration of an LED backlight and a liquid crystal display panel. The LED backlight 10 illuminates the liquid crystal display panel 18 from a back side of a display screen thereof. In the LED backlight 10, LEDs 10*r*, 10*g*, and 10*b* in three colors of RGB are arranged on an LED substrate 10*s*. A plurality of these LEDs 10*r*, 10*g*, and 10*b* of RGB are arranged on the LED substrate 10*s* so that all of which altogether are able to irradiate white light with each emission color. Further, light emission is able to be controlled according to a video image signal. For example, when there are many red color video image signals, light emission luminance of the LED 10*r* of R is increased relatively so as to be able to perform processing to improve color reproduction of a screen. Respective LEDs 10*r*, 10*b* and 10*g* are driven and controlled by the LED driving portion 15 (FIG. 1).

On the LED substrate 10*s*, a photo sensor 20*a* is arranged. The photo sensor 20*a* is to constitute a sensor part of the backlight luminance detection portion 20 of FIG. 1, and the backlight luminance detection portion 20 converts an output signal from the photo sensor 20*a* to a digital signal with a not-shown AD converter to be output to the main control portion 14.

In adjusting light emission luminance of the LED backlight 10 based on a detection result of light emission luminance of the LED backlight 10, the light emission luminance of each of LEDs of RGB is detected by the photo sensor 20*a* in a state where the optical shutter of the liquid crystal display panel 18 is closed. In this case, since the optical shutter is in the state of being closed, light transmission to a front side of the liquid crystal display panel is able to be suppressed as much as possible, so that the light emission luminance of the LED is able to be detected accurately by the photo sensor 20*a* with reflected light on the back side of the liquid crystal display panel 18.

Figure 3:
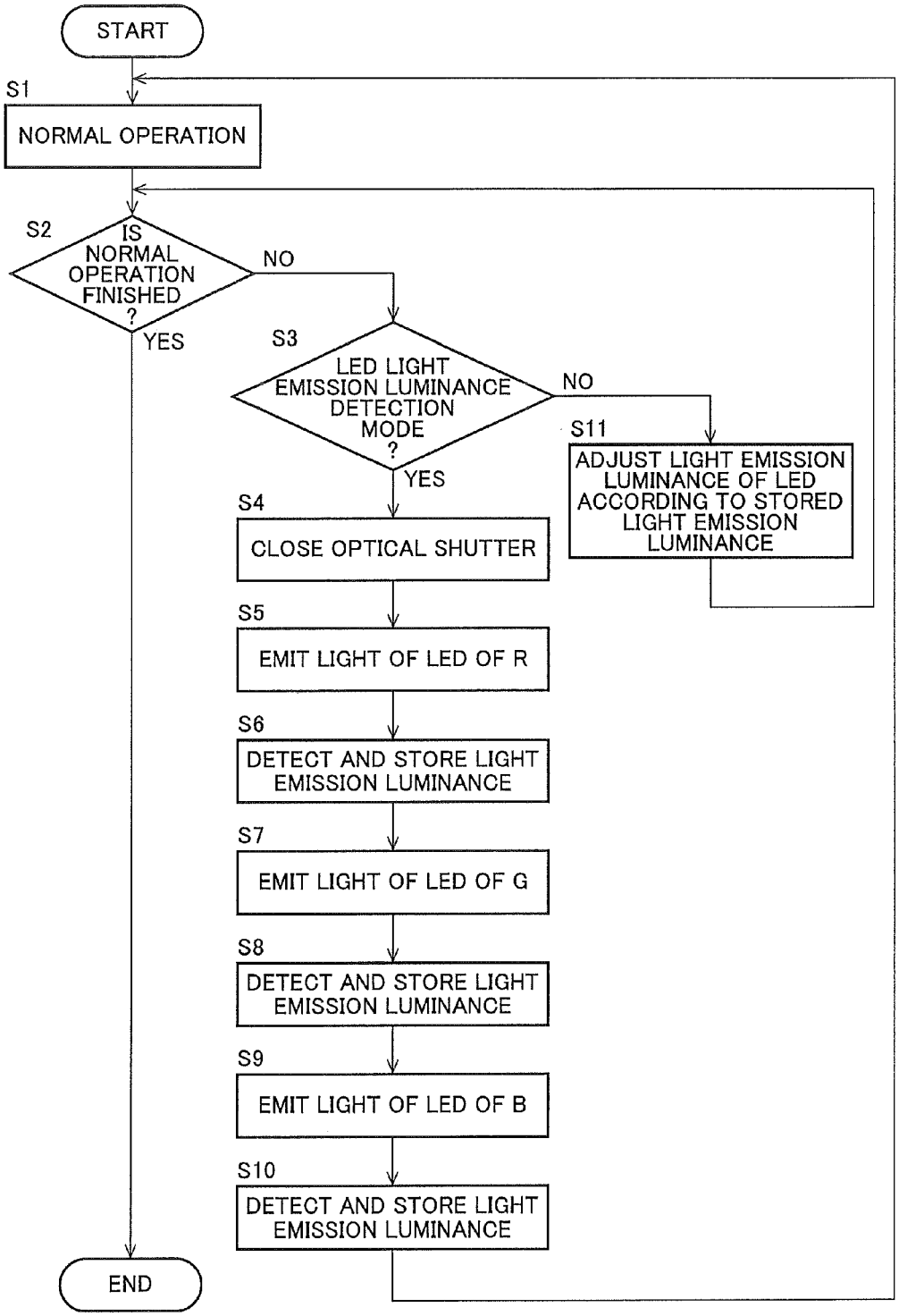
FIG. 3 is a flowchart for explaining an example of processing of the liquid crystal display apparatus according to the present invention.

FIG. 3 is a flowchart for explaining an example of processing of the liquid crystal display apparatus according to the present invention. In the liquid crystal display apparatus, normal operation is executed (step S1). The normal operation is normal operation for displaying contents such as a broadcast program or an advertisement to be viewed by a user, in which the LED backlight 10 is turned on and an optical shutter for each pixel is controlled based on a video image signal to be displayed so as to perform video image display on the liquid crystal display panel 18. Then, in the case of having operation input to finish the normal operation, the processing is finished (step S2—Yes).

When the normal operation is continued (step S2—No), whether to entering an LED light emission luminance detection mode is determined (step S3). The LED light emission luminance detection mode is a mode for detecting light emission luminance of an LED of the LED backlight 10 using the photo sensor 20*a* to perform processing to store data of the detected light emission luminance in the storage portion 19.

The LED light emission luminance detection mode is able to be executed by, for example, a predetermined user operation. Furthermore, shifting from the normal operation to the LED light emission luminance detection mode is able to be performed under a predetermined condition. For the predetermined condition, for example, based on a detection result by the ambient illuminance detection portion 16, when ambient illuminance is higher than a predetermined threshold, shifting to the LED light emission luminance detection mode is able to be performed. Alternatively, in a case where a current time belongs to a predetermined time slot, or in a case where a current time matches a predetermined time, shifting to the LED light emission luminance detection mode is able to be performed.

When the determination is made as being the LED light emission luminance detection mode at step S3, the optical shutter of the liquid crystal display panel 18 is closed (step S4). Here, for example, the liquid crystal shutter is closed by causing a state where display is performed at the lowest gradation of black in all pixels of the liquid crystal display panel 18. Then, among LEDs of RGB, only the LED of R is caused to emit light (step S5). Light emission luminance at the time is detected by the photo sensor 20*a* to be stored in the storage portion 19 (step S6). Next, the LED of R is turned off to cause the LED of G to emit light (step S7), and light emission luminance is detected by the photo sensor 20*a* to be stored in the storage portion 19 (step S8). Finally, the LED of G is turned off to cause the LED of B to emit light (step S9), and light emission luminance is detected by the photo sensor 20*a* to be stored in the storage portion 19 (step S10).

Thereafter, the process returns to step S1 to get back to the normal operation. In this case, since the normal operation is not finished and not in the LED light emission luminance detection mode, the process proceeds to step S11 and light emission luminance of the LED is adjusted according to light emission luminance of the LED stored in the storage portion 19 (step S11).

That is, the main control portion 14 compares the light emission luminance of the LED detected by the photo sensor 20*a* to be stored in the storage portion 19 with the light emission luminance of the LED stored in the storage portion 19 in advance, and performs, in the case of having an error occurred therebetween, control to increase or decrease the light emission luminance of the LED so as to eliminate the error. Here, for each of RGB, light emission control is performed by comparing light emission luminance newly detected by the photo sensor 20*a* with the light emission luminance stored in the storage portion 19. When actual light emission luminance detected by the photo sensor 20*a* matches the predetermined light emission luminance stored in the storage portion 19, video image display may be performed in white balance set initially.

In such a state, until the normal operation is finished at step S2, or shifting to the LED light emission luminance detection mode again at step S3, the LED is turned on with adjusted light emission luminance so as to continue normal operation.

As described above, in detecting light emission luminance of the LED by the photo sensor 20*a*, the optical shutter of the liquid crystal display panel 18 is closed, and transmission of light emitted from the LED to a front side of the liquid crystal display panel 18 is thereby able to be suppressed as much as possible, so that light emission luminance detection is able to be performed accurately and stably by the photo sensor 20*a*. Thereby, disturbance in white balance due to variation in light emission luminance of the LED is able to be corrected appropriately.

Figure 4:
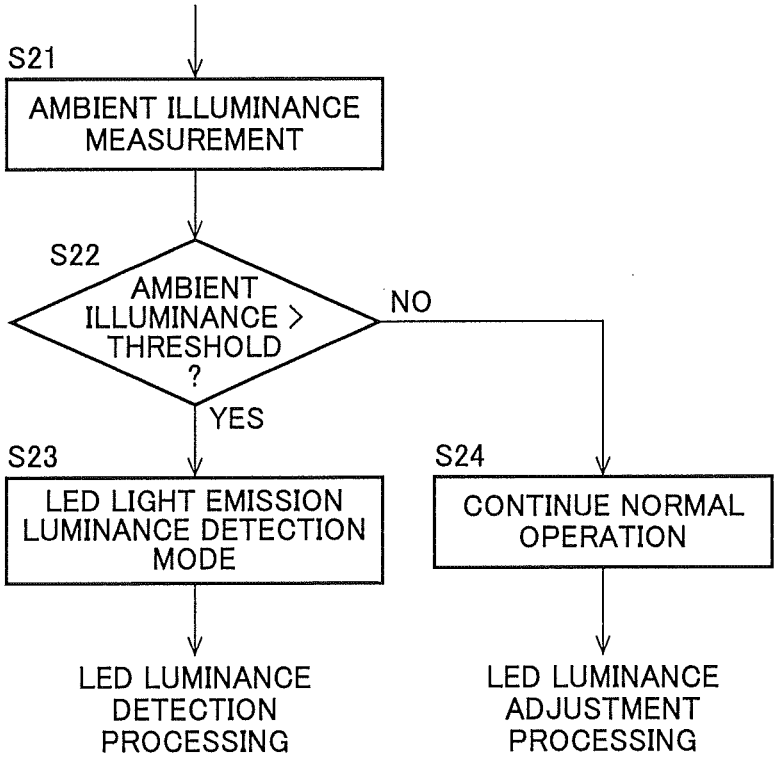
FIG. 4 is a flowchart for explaining an example of a predetermined condition of shifting to an LED light emission luminance detection mode.

FIG. 4 is a flowchart for explaining an example of a predetermined condition of shifting to an LED light emission luminance detection mode. At step S3 in FIG. 3, in the case of shifting from the normal operation to the LED light emission luminance detection mode, determination is made on whether to shift to the LED light emission luminance detection mode based on ambient illuminance of the liquid crystal display apparatus. Here, ambient illuminance (brightness) of the liquid crystal display apparatus 1 is measured by the ambient illuminance detection portion 16 during the normal operation (step S21).

Then, when the measured ambient illuminance is higher than a threshold determined in advance (step S22—Yes), judging is made that the process should shift to the LED light emission luminance detection mode (step S23). Then, the process goes to step S4 in FIG. 3 so as to execute detection processing of light emission luminance of an LED.

When the ambient illuminance of the liquid crystal display apparatus is higher than a predetermined level, luminance detection processing is performed by shifting to the LED light emission luminance detection mode, so that even though light is leaked to the front side of the liquid crystal display panel in a state where the optical shutter is closed, due to brightness of apparatus environment, it is possible to detect or correct the light emission luminance efficiently without giving a user a sense of discomfort so much.

Further, at step S22, when the measured ambient illuminance is not higher than the threshold determined in advance, judging is made that the normal operation is supposed to be continued without shifting to the LED light emission luminance detection mode (step S24). Then, the process proceeds to the step S11 to performs normal operation while adjusting the light emission luminance of the LED according to the light emission luminance of the LED stored in the storage portion 19.

In this case, in a case where light emission luminance detection of the LED is performed when the ambient illuminance is higher than the threshold, and thereafter the ambient illuminance is still high, detection processing of the light emission luminance of the LED may not be performed repeatedly and successively. For example, after detecting the light emission luminance once in the LED light emission luminance detection mode, the ambient illuminance is measured again after a lapse of a predetermined time, and when the ambient illuminance is higher than the threshold at the time, the light emission luminance detection processing of the LED may be performed again.

Figure 5:
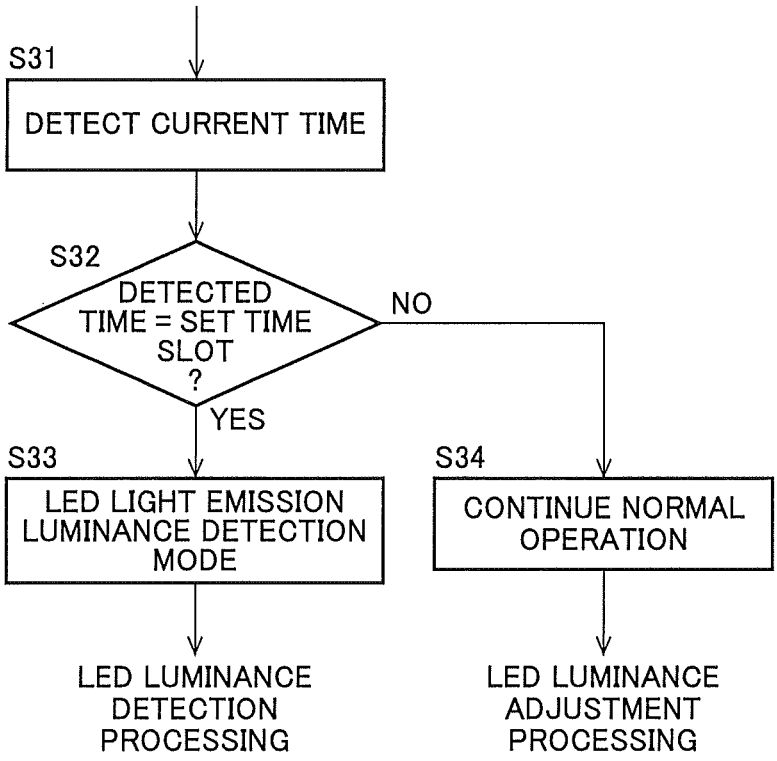
FIG. 5 is a flowchart for explaining another example of a predetermined condition of shifting to the LED light emission luminance detection mode.

FIG. 5 is a flowchart for explaining another example of a predetermined condition of shifting to the LED light emission luminance detection mode. In this example, at step S3 in FIG. 3, in the case of shifting from the normal operation to the LED light emission luminance detection mode, determination is made on whether or not to shift to the LED light emission luminance detection mode based on a current time. Here, the liquid crystal display apparatus 1 detects a current time by the clock 21 during normal operation (step S31).

Then, when the detected current time is included in a time slot determined in advance (step S32—Yes), judging is made that the process should shift to the LED light emission luminance detection mode (step S33). Then, the process proceeds to step S4 in FIG. 3 to execute detection processing of light emission luminance of an LED.

For the time slot determined in advance, for example, midnight hours such as 2 a.m. to 3 a.m. may be set. In the case where, for example, a large liquid crystal display apparatus for advertisement display or the like is provided, the time slot is one when few people are there around, and even though light is leaked to a front side of a liquid crystal display panel in a state where an optical shutter is closed, it is thus possible to detect or correct the light emission luminance without giving many people a sense of discomfort.

When the detected time at step S32 is not included in the time slot determined in advance, determination is made that the normal operation is performed without shifting to the LED light emission luminance detection mode (step S34). Then, the process proceeds to step S11 of FIG. 3 to execute the normal operation according to the light emission luminance of the LED stored in the storage portion 19 while adjusting the light emission luminance of the LED.

In this case, when the current time is included in the time slot determined in advance, the LED light emission luminance detection mode may not be performed continuously and repeatedly. For example, after performing light emission luminance detection processing once in the LED light emission luminance detection mode, a current time is detected again after a lapse of a predetermined time, and when the current time is included in the time slot determined in advance at the time, the light emission luminance detection processing of the LED may be executed again.

In addition, a condition of shifting to the LED light emission luminance detection mode may be set not as the predetermined time slot but as a specific time according to the detected time. In such a case, when a liquid crystal display apparatus performs the normal operation at the specific time, it is possible to shift to the LED light emission luminance detection mode.

Note that, in the embodiment described above, in the LED light emission luminance detection mode, it is assumed that an optical shutter for all pixels of the liquid crystal display panel 18 is closed and light emission luminance of LEDs of RGB is detected sequentially by the photo sensor 20*a*, however, the liquid crystal display panel 18 may be divided into a plurality of areas so that light emission luminance of an LED is detected for each of the plurality of areas to be adjusted.

In this case, the liquid crystal display panel 18 is divided into a plurality of areas, and for respective areas of the LED backlight 10 corresponding to the divided areas, a plurality of photo sensors 20*a* are provided. Then, for each divided area of the liquid crystal display panel 18, an optical shutter of each area is closed and an LED backlight corresponding to the area is turned on sequentially for each of RGB. The light emission luminance of the RGB which is turned on sequentially is detected by the photo sensor 20*a* in the area and compared with the light emission luminance stored in the storage portion 19 so that the light emission luminance of the LED is adjusted appropriately. Accordingly, in the storage portion 19, the light emission luminance of the LED and light emission luminance control amount data are stored for each of the RGB for each divided area.

With the configuration above, according to the liquid crystal display apparatus of the embodiment according to the present invention, light emission luminance of an LED is detected by the backlight luminance detection portion 20 using a photo sensor and the like, data of the detected light emission luminance is compared with data of light emission luminance stored in a state where white balance is adjusted in advance, so that even when a change in light emission luminance occurs due to temporal change or change in a light modulation level and the like of an LED, light emission luminance of the LED is adjusted so that video image display is able to be performed in appropriate white balance. Here, in the case of detecting light emission luminance of an LED by the backlight luminance detection portion 20, an optical shutter of the liquid crystal display panel 18 is brought to a closed state so that lowering of a detected light amount due to transmission in a liquid crystal display panel is suppressed as much as possible, and accurate and stable light emission luminance detection is able to be performed.

Additionally, the detection processing of light emission luminance of an LED by the LED luminance detection is able to be executed appropriately without giving a sense of discomfort to a person who sees a screen of a liquid crystal display apparatus, by being executed in a brighter environment than a predetermined threshold, or being executed in a predetermined time slot or time.

Hereinabove, according to the present invention, it is possible to provide a liquid crystal display apparatus in which adjustment of white balance based on a measurement result of emission luminance of a backlight is able to be executed accurately and effectively.

Further, according to the present invention, emission luminance of a backlight is detected by a backlight luminance detection portion and the detected light emission luminance is compared with light emission luminance stored in a state where white balance is adjusted in advance, so that even when change occurs in light emission luminance of a backlight, it is possible to perform video image display in appropriate white balance by adjusting the light emission luminance of the backlight. Then, in adjusting light emission luminance of a backlight by the backlight luminance detection portion, the optical shutter of a liquid crystal display panel is brought to a closed state, thereby making it possible to perform accurate and stable luminance detection while suppressing lowering of a detected light amount due to transmission in the liquid crystal display panel as much as possible.

Then, the adjustment processing of light emission luminance of a backlight by luminance detection of the backlight is executed when ambient illuminance is higher than a predetermined threshold or executed at a predetermined time slot or time, so that luminance correction processing is appropriately executed without giving a sense of discomfort to a person who sees a screen of a liquid crystal display apparatus.

The invention claimed is:

1. A liquid crystal display apparatus comprising:

a liquid crystal display panel;

a backlight for illuminating the liquid crystal display panel from a back side thereof;

a control portion for controlling the liquid crystal display panel and the backlight;

a backlight luminance detection portion for detecting light emission luminance of the backlight on the back side of the liquid crystal display panel; and an ambient illuminance detection portion for detecting ambient illuminance of the liquid crystal display apparatus, wherein when ambient illuminance detected by the ambient illuminance detection portion is higher than a predetermined threshold, the backlight luminance detection portion detects light emission luminance of the backlight in a state where an optical shutter of the liquid crystal display panel is closed, and the control portion adjusts light emission luminance of the backlight according to the light emission luminance detected by the backlight luminance detection portion, and when ambient illuminance detected by the ambient illuminance detection portion is not higher than a predetermined threshold, the backlight luminance detection portion does not detect light emission luminance of the backlight.

2. The liquid crystal display apparatus as defined in claim 1, wherein the backlight is comprised of LEDs in three colors of RGB, a storage portion is provided for storing, when light of each of the LEDs of RGB is emitted in a state where white balance is adjusted in advance, light emission luminance of each of RGB detected by the backlight luminance detection portion, the backlight luminance detection portion detects light emission luminance of each of the LEDs of RGB when adjusting light emission luminance of the backlight, and the control portion compares the light emission luminance of RGB detected by the backlight luminance detection portion with light emission luminance of RGB stored in the storage portion, and adjusts, when an error occurs between the compared light emission luminance, the light emission luminance of each of the LEDs of RGB so as to eliminate the error.

3. The liquid crystal display apparatus as defined in claim 2, wherein an ambient illuminance detection portion for detecting ambient illuminance of the liquid crystal display apparatus is included, and the control portion executes processing to adjust light emission luminance of the backlight according to light emission luminance detected by the backlight luminance detection portion when ambient illuminance detected by the ambient illuminance detection portion is higher than a predetermined threshold.

4. The liquid crystal display apparatus as defined in claim 2, wherein a clock for detecting a current time is included, and the control portion executes processing to adjust light emission luminance of the backlight according to light emission luminance detected by the backlight luminance detection portion when a current time detected by the clock belongs to a predetermined time slot or matches a predetermined time.

* * * * *